United States Patent [19]

Meyer

[11] 4,390,283

[45] Jun. 28, 1983

[54] MAGNETIC STRIRRER FOR SAMPLE CONTAINER

[75] Inventor: Richard C. Meyer, La Habra, Calif.

[73] Assignee: Beckman Instruments, Inc., Fullerton, Calif.

[21] Appl. No.: 280,428

[22] Filed: Jul. 6, 1981

Related U.S. Application Data

[63] Continuation of Ser. No. 71,812, Sep. 4, 1979, abandoned.

[51] Int. Cl.[3] ..... B01F 13/08; B01F 15/00

[52] U.S. Cl. ..... 366/142; 366/213; 366/224; 366/225; 366/273

[58] Field of Search ..... 366/273, 274, 220, 224, 366/225, 142, 230–232, 213; 356/246

[56] References Cited

U.S. PATENT DOCUMENTS

| | | | |
|---|---|---|---|
| Re. 28,984 | 9/1976 | Drinkuth et al. . | |
| 1,242,493 | 10/1917 | Stringham . | |
| 1,757,818 | 5/1930 | Streich et al. . | |
| 2,543,495 | 2/1951 | Henry . | |
| 2,837,320 | 6/1958 | Baron . | |
| 2,890,869 | 6/1959 | Sohn . | |
| 3,496,369 | 2/1970 | Makino et al. . | |
| 3,572,651 | 3/1971 | Harker . | |
| 3,784,170 | 1/1974 | Petersen et al. . | |
| 3,900,186 | 8/1975 | Balas . | |
| 3,947,122 | 3/1976 | Walker . | |
| 3,966,333 | 6/1976 | Marcus . | |
| 3,981,594 | 9/1976 | George . | |
| 4,058,737 | 11/1977 | Takahashi et al. . | |
| 4,063,823 | 12/1977 | Grat . | |
| 4,156,570 | 5/1979 | Wardlaw . | |
| 4,157,871 | 6/1979 | Anderson et al. | 356/341 |

*Primary Examiner*—Philip R. Coe
*Assistant Examiner*—Timothy F. Simone
*Attorney, Agent, or Firm*—R. J. Steinmeyer; J. E. Vanderburgh; Timothy R. Schulte

[57] ABSTRACT

A magnetic stirring arrangement for stirring sample material held within a cylindrical glass sample container for assay. A stirring element within the container is retained in a fixed orientation by an external magnetic field. The container and the contents thereof are rotated in place causing the container contents to be stirred by rotational motion around and past the fixed stirring element.

5 Claims, 2 Drawing Figures

MAGNETIC STRIRRER FOR SAMPLE CONTAINER

This is a continuation of application Ser. No. 071,812, filed Sept. 4, 1979 now abandoned.

BACKGROUND OF THE INVENTION

1. Field of the Invention

The present invention relates generally to the stirring of sample materials and, more particularly, to magnetic stirrers for containers which hold the sample material.

2. Description of the Prior Art

U.S. Pat. No. 4,157,871 discloses a nephelometric system for the assay of antigens and antibodies supported within cylindrical glass containers. In such analysis, an antigen and an antibody are combined in the container and are stirred by a magnetic stirring element within the container. The stirring element is rotated by a motor-driven permanent magnet outside of the container and magnetically coupled to the stirring element. The reaction which results between the combined sample components produces a precipitate which increases in quantity and turbidity as the reaction progresses. The system measures the amount of light scattered by the precipitate to derive quantitative or qualitative information about the antigen or antibody sample components. In this system it is preferred to stir the reactants while measuring light scatter in order to sweep all precipitate particles past the detector field of view. This minimizes errors which could otherwise result due to increased scatter from large particles lodging motionless in the detector field of view.

The magnetic stirring arrangement for the foregoing system is similar to that in FIG. 1 of U.S. Pat. No. 3,784,170. In this regard a magnetic stirring bar is horizontally disposed in the bottom of a cylindrical glass sample container. A rotating permanent magnet magnetically coupled to the stirring element is positioned below the container and is rotated by a drive motor in a horizontal plane to correspondingly rotate the stirring bar inside the container. While the foregoing magnetic stirring arrangement has proved satisfactory in the foregoing nephelometric assays, its use has been restricted to sample containers which remain stationary at the measuring station during an optical measuring interval.

SUMMARY OF THE INVENTION

The present invention resides in an improved magnetic stirring arrangement for sample containers which exhibits a greater flexibility than prior arrangements in its adaption for use with rotating sample containers. The stirring arrangement is simple in design, straightforward in operation, and is readily incorporated into prior systems having driven magnetic stirring elements.

To the foregoing ends the invention in its broadest aspects contemplates apparatus of the type having a sample container for holding sample material to be assayed and a stirring element within the container for stirring material therein in which the improvement comprises (1) means for rotatably supporting the sample container, (2) means for rotating the sample container to cause corresponding rotational movement of material therein, and (3) magnetic means external to the container and magnetically coupled to the stirring element therein in a manner restraining the stirring element in a fixed position during rotation of the sample container. With this arrangement stirring of the sample material is achieved during container rotation by the rotational motion of the sample material around and past the fixed stirring element. In one embodiment the external magnetic means comprises two permanent magnet pole pieces affixed outside of the container to retain the stirring element in its fixed position. In a second embodiment the magnetic means comprises a switchable magnet, such as an electromagnet, whose field is switchable on and off. Either arrangement is thus ideally suited for incorporation in sample measuring systems, such as nephelometers or other photometric systems, in which the sample can be stirred and measured simultaneously and where both of the stirring and measuring operations are to be achieved as the container rotates. In the second embodiment, with the magnetic field disabled, the stirring element is allowed to move freely in the rotating container, permitting container rotation for measuring or other operation but without stirring.

DESCRIPTION OF THE PREFERRED EMBODIMENT

Figure 1:
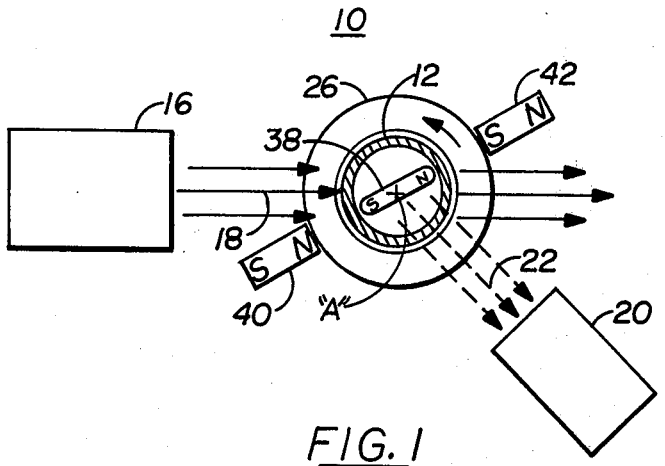
FIG. 1 is a top plan view of the measuring station of a nephelometer incorporating the magnetic stirring arrangement of the present invention.
Figure 2:
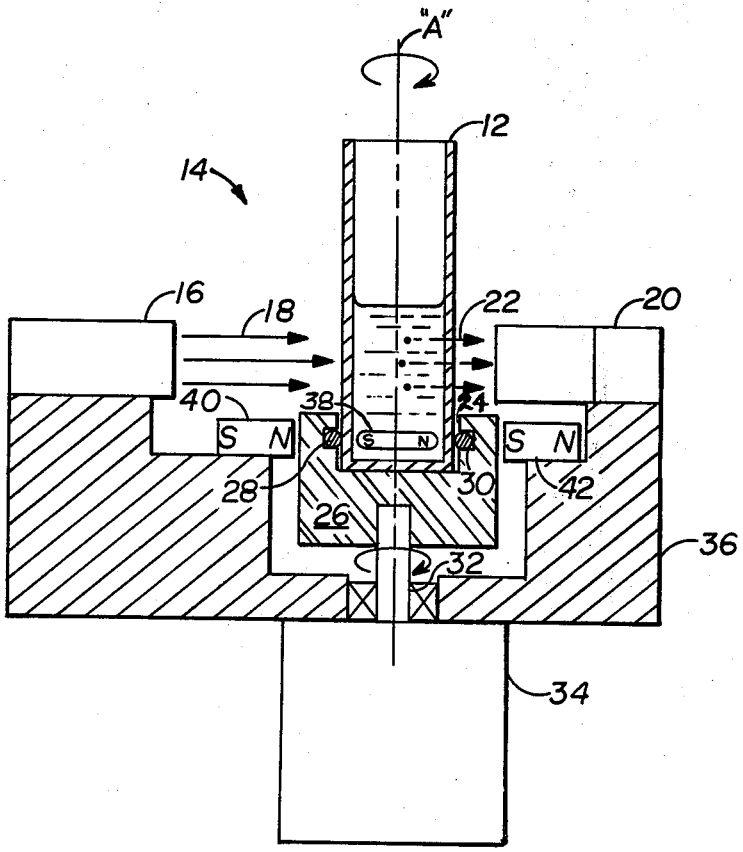
FIG. 2 is a view of the apparatus of FIG. 1 taken in a generally vertical plane through the measuring station.

As shown in the drawing for purposes of illustration, the invention is embodied in a nephelometer indicated generally by the mumeral 10 which receives a sample container 12 at an optical measuring station for measurement of the container contents and for stirring of the contents in accordance with the present invention. The sample container is illustrated as an optically transparent cylindrical glass shell vial the interior of which defines a chamber for receiving chemical reactants or other sample materials to be measured. The nephelometer further includes an optical excitation system 16 for directing a beam of light along a predetermined axis 18 into the sample container and an optical detection system 20 for detecting light scattered by the contents of the container and passing therefrom along an optical axis 22. Axes 18 and 22 lie in a generally horizontal plane perpendicular to the vertical axis "A" of sample container 12. Elements of the optical excitation and detection systems 16 and 18 are conventional and reference is made to U.S. Pat. Nos. 4,157,871 and 4,136,953 for further details regarding these systems.

In accordance with a primary aspect of the present invention the sample container 12 is rotatably supported at the measuring station 14 in a manner allowing the container to be rotated about its vertical axis "A". To this end the bottom of container 12 is received within a well 24 of a generally circular supporting member 26 and is securely retained therein by an O-ring structure 28 which grips the outer circumference of the container. The O-ring is itself seated within annular inwardly facing groove 30 in the vertical wall of well 24. The supporting member 26, in turn, is rigidly affixed to the output shaft of a drive motor 34. Motor 34 is secured to the overall frame 36 of the nephelometer. Thus arranged motor 34 on command rotates supporting element 26 and hence rotates the sample container 12 about its vertical axis "A".

In accordance with a further aspect of the invention, a magnetic stirring arrangement for stirring the contents of sample container 12 includes a conventional magnetic stirring element 38, such as a permanent magnet cylindrical rod or bar, horizontally disposed in the bottom of container 12. Moreover, a pair of permanent magnets 40 and 42 pole pieces are affixed securely to frame 36 outside of the container on diametrically opposite sides thereof in positions to be magnetically coupled to the stirring element. As illustrated in the Figures, one magnetic pole of each external magnet 40 and 42 is aligned with and magnetically coupled to opposite polarity magnetic pole of the stirring element. Thus arranged, the external magnets 40 and 42 establish a magnetic field restraining and holding the stirring element in a fixed horizontal position generally perpendicular to the vertical axis "A". Consequently, when drive motor 34 is actuated to rotate sample container 12, the container sample contents, which rotate together with the container, are stirred by the rotational motion of the rotating sample material around and past the stationary stirring element 38.

In operation of the described nephelometric system, when the antigen and antibody reaction components are to be introduced into the sample container 12, the optical excitation system 16 and the optical detection system 18 are appropriately enabled by a system control (not shown) in a conventional manner for the duration of the required optical interval. For rate nephelometry, an optical measuring interval of one minute or so may be established during which time the optical detection means in the detection system 18 measures the increase in light scattered by the precipitate as the precipitate forms. In endpoint nephelometry, by contrast, the measuring interval may be much briefer, for example a few seconds or so, since the scatter measurement of interest is simply the value of the scatter signal at a particular point in time. In either case, motor 34 is energized to rotate sample container 12 during the optical measurement interval of interest. In this manner, the container contents are likewise rotated over and past the stirring element 38 to stir the container contents by container rotation during the measurement interval. In addition, from an optical standpoint, the detection system 18 views all window areas in all rotational orientations of the sample container 12. Accordingly, the optical variations in the output scatter signal induced by imperfections (e.g. scratches, bubbles, deformations, etc.) and other optical variations in the different window areas of the sample container are averaged to derive an optical background error signal value which is essentially the same for all measurements with that container 12 as well as for measurements with different individual containers of the same size and characteristics. Consequently, the system is rendered insensitive to the optical variations or imperfections in individual window areas of the containers.

The speed at which container 12 is rotated will depend on the nature and quantity of the sample materials and the required level of stirring efficiency and, from an optical standpoint, on the nature of the imperfections in the container wall areas and on the variation of the scattered light signal with time. For example, in rate measurements the scatter signal will increase as precipitate forms and the detection means must respond to the changing scatter signal with a time constant enabling the changing scatter signal to be accurately tracked. Also, perturbations or noise will be generated by and as the optical variations in the container wall rotate past the detection system. Such noise pulses are superimposed on the basic sample scatter signal and should be of a sufficiently high frequency to be readily discriminated electronically from the scatter signal itself. For this reason, since the noise frequency is a function of rotational speed, it is desirable that the container be rotated at a speed substantially greater than the time constant of the optical detection system.

While the external magnetic means retaining the stirring element 38 are illustrated as permanent magnet pole pieces 40 and 42, in an alternative embodiment one or both pole pieces represent a switchable magnetic means, such as an electromagnet, which is manually or automatically switched on or off to enable or disable the magnetic field coupled to the stirring element. In this manner, with the field of the electromagnetic switched on, the stirring element 38 is magnetically retained in its fixed horizontal position and operation of the system would be in a manner identical to that previously described. However, by switching the electromagnet off, the magnetic field is removed allowing the stirring element to move freely within the sample container 12 and hence to rotate along with the rotating container and its contents. This is be desirable where, after the contents are stirred in the above described manner, it is preferred to optically or otherwise measure the container contents while the container rotates but without stirring taking place.

While the preferred embodiments of the stirring arrangement have been illustrated in a nephelometric assay system, it will be apparent that the invention may be readily applied to the stirring of the sample material to be measured in any manner whether photometrically or otherwise. Moreover, the invention is readily adapted for incorporation in prior systems having a rotating external magnet drive system, since the same drive system may be adapted with the present invention for driving (rotating) the sample container. Moreover, while a preferred embodiment of the invention has been illustrated and described, it will be apparent that modifications may be made therein without departing from the spirit and scope of the invention as defined in the appended claims.

What is claimed is:

1. In apparatus of the type having a sample container for holding sample material to be assayed and a stirring element within the container for stirring material therein, said stirring element separate from said container to allow relative movement of said container with respect to said stirring element, the improvement comprising:

means for rotatably supporting the sample container;

means for rotating the sample container to cause corresponding rotational movement of material therein; and magnetic means external to the container and magnetically coupled to the separate stirring element therein in a manner retaining the separate stirring element in a fixed relative position during rotation of the sample container whereby stirring of the sample material is achieved during said rotation by the rotational motion of the sample material around and past the fixed stirring element.

2. The apparatus of claim 1 wherein the container is a cylindrical vial supported for rotation about its cylindrical axis, and the separate stirring element is retained in a position within the container generally perpendicular to the cylindrical axis by the magnetic means.

3. The apparatus of claim 1 or claim 2 wherein the magnetic means comprises one or more permanent magnetic pole pieces in fixed position external to the container and magnetically coupled to the separate stirring element.

4. The apparatus of claim 1 or claim 2 wherein the magnetic means is switchable to enable or disable the magnetic field coupled to the separate stirring element.

5. In apparatus of the type having a sample container for holding sample material to be assayed and a stirring element within the container for stirring the material therein, said stirring element separate from said container to allow relative movement of said container with respect to said stirring element, the improvement comprising:

means for rotatably supporting the sample container;

means for rotating the sample container to cause corresponding rotational movement of material therein;

magnetic means external to the container and magnetically coupled to the separate stirring element therein in a manner retaining the separate stirring element in a fixed relative position during rotation of the sample container whereby stirring of the sample material is achieved during said rotation by a rotational motion of the sample material around and past the fixed stirring element;

means for disabling the coupling of the magnetic field to the separate stirring element to release the separate stirring element from the fixed relative position in the sample container; and means for measuring the sample material during rotation of the sample container with the magnetic field coupling to the separate stirring element disabled.

* * * * *